US007135913B2

(12) United States Patent
Min et al.

(10) Patent No.: US 7,135,913 B2
(45) Date of Patent: Nov. 14, 2006

(54) REFERENCE VOLTAGE GENERATING CIRCUIT FOR INTEGRATED CIRCUIT

(75) Inventors: Young-Sun Min, Seoul (KR); Nam-Jong Kim, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 103 days.

(21) Appl. No.: 10/964,016

(22) Filed: Oct. 13, 2004

(65) Prior Publication Data

US 2005/0093617 A1 May 5, 2005

(30) Foreign Application Priority Data

Oct. 29, 2003 (KR) ..... 10-2003-0075749

(51) Int. Cl.
*G05F 3/24* (2006.01)
*G05F 3/26* (2006.01)

(52) U.S. Cl. ..... 327/541; 327/539; 323/313

(58) Field of Classification Search ..... 327/539–543; 323/313–316

See application file for complete search history.

(56) References Cited

U.S. PATENT DOCUMENTS 6,031,365 A * 2/2000 Sharpe-Geisler ..... 323/313
6,087,820 A 7/2000 Houghton et al. ..... 323/315
6,204,724 B1 3/2001 Kobatake ..... 327/541
6,617,835 B1 * 9/2003 Nishimura ..... 323/313
6,972,550 B1 * 12/2005 Hong ..... 323/315

* cited by examiner

*Primary Examiner*—Timothy P. Callahan
*Assistant Examiner*—Terry L. Englund
(74) *Attorney, Agent, or Firm*—Mills & Onello LLP

(57) ABSTRACT

A reference voltage generating circuit has a power supply voltage node to which a driving power supply voltage is intermittently applied. The circuit includes; a first current mirror section including a first MOS transistor of a first conductivity type having a source terminal connected to the power supply voltage node and a gate terminal connected to a drain terminal as a reference voltage output node, and a second MOS transistor of the first conductivity type having a gate terminal connected to the gate terminal of the first MOS transistor of the first conductivity type and a source terminal connected to the power supply voltage node; a second current mirror section including a third MOS transistor of a second conductivity type having a drain terminal connected to the reference voltage output node and a source terminal connected to a first current path to which a first resistor and a first diode are serially connected, and a fourth MOS transistor of the second conductivity type having a gate terminal and a drain terminal connected to the gate terminal of the third MOS transistor of the second conductivity type in common and a source terminal connected to the second current path to which a second diode is serially connected; and a charge transporting section connected between the gate terminal of the first MOS transistor of the first conductivity type in the first current mirror section and the gate terminal of the fourth MOS transistor of the second conductivity type in the second current mirror section.

13 Claims, 6 Drawing Sheets

REFERENCE VOLTAGE GENERATING CIRCUIT FOR INTEGRATED CIRCUIT

CROSS-REFERENCE TO RELATED APPLICATION

This application claims the benefit of Korean Patent Application No. 2003-0075749, filed on Oct. 29, 2003, the contents of which are hereby incorporated herein by reference in their entirety.

BACKGROUND

1. Technical Field

The present invention relates to a reference voltage generating circuit for an integrated circuit and, more particularly, to a reference voltage generating circuit for an integrated circuit for use in an on-chip temperature sensor.

2. Discussion of the Related Art

Generally, a variety of semiconductor devices implemented by integrated circuit chips such as CPUs, memories, gate arrays or the like are used in a variety of electrical products, such as portable personal computers, personal digital assistants (PDAs), servers, portable telephones, or workstations. Many of such electrical products implement a sleep mode to save power, in which most of the circuit components in the products remain in a turn-off state. However, for example, a semiconductor memory, such as a DRAM or the like, belonging to a volatile memory, must perform a self-refreshing operation on data in a memory cell so that the data stored in the memory cell continues to be reserved. The DRAM consumes self-refresh power due to the required self-refreshing operation. It is very important to reduce power consumption in a battery-operated system that requires lower power, which is a critical issue.

One attempt to reduce power consumption required for the self-refresh is to change a refresh period depending on temperature. A time period for which data is reserved in the DRAM becomes longer as temperature becomes lower. Accordingly, it is certain that dividing a temperature area into several temperature areas and lowering the frequency of a refresh clock relatively in lower temperature areas of the temperature areas reduces power consumption. Here, in order to determine internal temperature of the DRAM, a built-in temperature sensor having less power consumption is necessary and in turn a reference voltage generator for providing a reference voltage to the temperature sensor becomes necessary. In such a reference voltage generator, a high-speed response characteristic and stability of operation is a very important matter since ON and OFF operations are being iterated for the purpose of reducing power consumption.

A typical circuit configuration of a band-gap reference type of reference voltage generator is shown in FIG. 1.

Referring to FIG. 1, a reference voltage generator 10 includes a first current mirror section composed of P-type MOS transistors MP1 and MP2, a second current mirror section composed of N-type MOS transistors MN1 and MN2, a first resistor R and a first diode D2 serially connected to each other on a first current path, a second diode D1 connected to a second current path, and a driving switching section IN1 and PD1 for applying a driving power supply voltage to a power supply node of the first current mirror section. Here, the junction diodes D2 and D1 connected to branches A and B, respectively, of the first and second current paths have the same dimension. The P-type MOS transistors MP1 and MP2 have a size ratio of 1:1 and the N-type MOS transistors MN1 and MN2 have a size ratio set to 1:1 as well. Here, the size indicates a channel length L multiplied by a gate width W.

The operation of the reference voltage generator shown in FIG. 1 will be described hereinafter.

The driving power supply voltage VDD is applied to the sources of the P-type MOS transistors MP1 and MP2 of the first current mirror section only if the P-type MOS transistor PD1 making up the drive switching section is in a turn-on state.

If the driving power supply voltage is applied to the first current mirror section, the current mirror operations of the P-type MOS transistors MP1 and MP2 and the N-type MOS transistors MN1 and MN2 allow a current of IO:Ir=1:1 to flow, and voltages appearing at the branches A and B become the same level.

In a turn-on period of a typical junction diode, a current formula becomes $I=Is\{e(VD/VT)-1\}\approx Is*e(VD/VT)$, where Is is a reverse saturation current, VD is a diode voltage, and VT is kT/q and indicates a thermal voltage.

Since the voltages appeared at the branches A and B are identical to each other, VA=VB=VD1=VD2+Ir*R and IO=Is*e(VD1/VT)→VD1=VT*ln(IO/Is).

In addition, since Ir=Is*e(VD2/VT)→VD2=VT*ln(Ir/Is)=VT*ln(M*IO/Is), VT*ln(IO/Is)=VT*ln(M*OI/Is)+Ir*R.

Accordingly, since Ir=VT*ln(M)/R, a current proportional to the temperature will flow through the branch A. On the other hand, a voltage across the branch B appears as VB=VD1=VT*ln(IO/Is).

Normally, since the reverse saturation current Is significantly increases with increase of the temperature relative to the VT, the diode voltage has a feature of decrease with the temperature. That is, since the VB decreases with temperature increase, IO decreases with the temperature.

Consequently, if the driving power supply voltage VDD is applied, a reference voltage OUT having a temperature-compensated, constant voltage level is outputted from the reference voltage output node al of the reference voltage generator.

However, in the circuit as shown in FIG. 1, if a switching control signal EN is alternated between a high state and a low state in a short time period, the P-type MOS transistor PD1 is repeatedly turned ON and OFF. The operation of the reference voltage generator may cause the following problem.

First, if a high switching control signal EN is applied, the P-type MOS transistor PD1 is turned ON and in turn the P-type MOS transistors MP1 and MP2 of the first current mirror section begin to be turned ON. At this time, since the voltage level of the reference voltage output node a1 rises earlier than the voltage level of the node a2 because of properties of the circuit, the P-type MOS transistors MP1 and MP2 may be turned OFF before the voltage level at the node a2 rises to a sufficient level. In this case, since the voltage of the node a2 does not reach a required sufficient level, it causes the current mirror operation of the second current mirror section, which is composed of the N-type MOS transistors MN1 and MN2, to be unstable or even to be disabled.

As such, an early turn-off operation of the P-type MOS transistors MP1 and MP2 in a period for which the driving power supply voltage VDD is initially supplied makes the current mirror operation of the second current mirror section unstable. Accordingly, a time period until the voltage level of the reference voltage output node a1 is set to a normal voltage level is long, resulting in deterioration of high-speed response characteristics of the circuit.

If the switching control signal EN is applied in the low state, the P-type MOS transistor PD1 is turned OFF and in turn the P-type MOS transistors MP1 and MP2 of the first current mirror section and the N-type MOS transistors MN1 and MN2 of the second current mirror section are also turned OFF. In this case, the first resistor R and the first diode D2 may make the voltage level of the node a3 in a floating state. If the node a3 is in the floating state, a long time is taken until the first and second current mirror sections mature into their normal operation when the switching control signal EN is applied back in the high state.

In the conventional circuit as shown in FIG. 1, a setup time for the circuit is long since a long time is taken for stabilizing a voltage level at each node when power is supplied. Therefore, the circuit has a problem in that a high-speed response characteristic is degraded. Further, there is a problem in that if particular nodes become in a floating state upon power-off, more time is initially taken until the voltage level is stabilized upon next power application.

Accordingly, for a reference voltage generating circuit which is used at places where power becomes on/off repeatedly, a technique is required allowing a voltage level at each node to reach a required voltage level as soon as possible after power is supplied. That is, there is a need for a reference voltage generating circuit having a high-speed response characteristic and guaranteeing stability of operation.

SUMMARY OF THE INVENTION

Accordingly, it is a feature of the present invention to provide a reference voltage generating circuit for an integrated circuit capable of solving the aforementioned problems of a prior art.

It is another feature of the present invention to provide a reference voltage generating circuit for an integrated circuit having a high-speed response characteristic upon applying a driving power supply voltage.

It is yet another feature of the present invention to provide a reference voltage generating circuit for an integrated circuit capable of stabilizing an initial current mirror operation when a driving power supply voltage is switched.

It is yet another feature of the present invention to provide a reference voltage generating circuit for an integrated circuit in which the circuit has a high-speed response characteristic and guarantees stability of operation.

It is yet another feature of the present invention to provide a reference voltage generating circuit suitable for being employed for a temperature sensor mounted on an integrated circuit chip, such as a semiconductor memory or the like.

According to one aspect of the present invention, there is provided a reference voltage generating circuit for an integrated circuit, the reference voltage generating circuit having a power supply voltage node to which a driving power supply voltage is intermittently applied. The reference voltage generating circuit of the invention includes: a first current mirror section including a first MOS transistor of a first conductivity type having a source terminal connected to the power supply voltage node and a gate terminal connected to a drain terminal as a reference voltage output node, and a second MOS transistor of the first conductivity type having a gate terminal connected to the gate terminal of the first MOS transistor of the first conductivity type and a source terminal connected to the power supply voltage node; a second current mirror section including a third MOS transistor of a second conductivity type having a drain terminal connected to the reference voltage output node and a source terminal connected to a first current path to which a first resistor and a first diode are serially connected, and a fourth MOS transistor of the second conductivity type having a gate terminal and a drain terminal connected to the gate terminal of the third MOS transistor of the second conductivity type in common and a source terminal connected to the second current path to which a second diode is serially connected; and a charge transporting section connected between the gate terminal of the first MOS transistor of the first conductivity type in the first current mirror section and the gate terminal of the fourth MOS transistor of the second conductivity type in the second current mirror section.

In one embodiment, the reference voltage generating circuit for the integrated circuit may further comprise a driving switching section for selectively applying the driving power supply voltage to the power supply node in response to a first switching control signal. The reference voltage generating circuit may further comprise a current sink section for connecting to a ground voltage the source terminal of the third MOS transistor of the second conductivity type, in response to a second switching control signal. Here, the current sink section may include a sixth MOS transistor of the second conductivity type having a gate terminal for receiving the second switching control signal, a drain terminal connected to the first current path, and a source terminal connected to the ground voltage. In one embodiment, the second switching control signal has a phase opposing that of the first switching control signal.

In one embodiment, the charge transporting section is a fifth MOS transistor of the second conductivity type having a drain terminal and a gate terminal connected to the gate terminal of the first MOS transistor of the first conductivity type, and having a source terminal connected to the gate terminal of the fourth MOS transistor of the second conductivity type.

In one embodiment, the charge transporting section is a third diode having an anode connected to the gate terminal of the first MOS transistor of the first conductivity type and a cathode connected the gate terminal of the fourth MOS transistor of the second conductivity type.

In one embodiment, the reference voltage generating circuit for the integrated circuit is a band-gap reference type circuit for generating a reference voltage of an on-chip temperature sensor.

In one embodiment, the second conductivity type MOS transistors are N-type MOS field effect transistors when the first conductivity type MOS transistors are P-type MOS field effect transistors.

In accordance with another aspect, the invention is directed to a reference voltage generating circuit having a power supply voltage node to which a driving power supply voltage is periodically applied, comprising: a first current mirror section including a first MOS transistor of a first conductivity type having a source terminal connected to the power supply voltage node and a gate terminal connected to a drain terminal as a reference voltage output node, and a second MOS transistor of the first conductivity type having a gate terminal connected to the gate terminal of the first MOS transistor of the first conductivity type and a source terminal connected to the power supply voltage node; a second current mirror section including a third MOS transistor of a second conductivity type having a drain terminal connected to the reference voltage output node and a source terminal connected to a first current path to which a first resistor and a first diode are serially connected, and a fourth MOS transistor of the second conductivity type having a gate terminal and a drain terminal connected to the gate terminal of the third MOS transistor of the second conductivity type in common and a source terminal connected to the second current path to which a second diode is serially connected; a charge transporting section connected between the gate terminal of the first MOS transistor of the first conductivity type in the first current mirror section and the gate terminal of the fourth MOS transistor of the second conductivity type in the second current mirror section; a driving switching section for applying the driving power supply voltage to the power supply voltage node in response to a first switching control signal; and a current sink section for connecting the source terminal of the third MOS transistor of the second conductivity type to a ground voltage in response to a second switching control signal.

In one embodiment, the charge transporting section is a fifth MOS transistor of the second conductivity type having a drain terminal and a gate terminal connected to the gate terminal of the first MOS transistor of the first conductivity type, and having a source terminal connected to the gate terminal of the fourth MOS transistor of the second conductivity type.

In one embodiment, the driving switching section comprises: an inverter for inverting the phase of the first switching control signal; and a first conductivity type MOS transistor having a gate terminal for receiving an output of the inverter, a source terminal for receiving the driving power supply voltage, and a drain terminal connected to the power supply voltage node.

In one embodiment, the current sink section is a sixth MOS transistor of the second conductivity type having a gate terminal for receiving the second switching control signal, a drain terminal connected to the first current path, and a source terminal connected to the ground voltage.

In one embodiment, the circuit is applied to a semiconductor temperature sensor.

According to the reference voltage generating circuit for an integrated circuit of the present invention, an initial current mirror operation can be stabilized in a short time when a driving power supply voltage is switched, thereby enhancing a high-speed response characteristic and stability of operation.

BRIEF DESCRIPTION OF THE DRAWINGS

The foregoing and other features and advantages of the invention will be apparent from the more particular description of an embodiment of the invention, as illustrated in the accompanying drawing. The drawing is not necessarily to scale, emphasis instead being placed upon illustrating the principles of the invention. Like reference characters refer to like elements throughout the drawings.

DETAILED DESCRIPTION OF THE INVENTION

Figure 1:
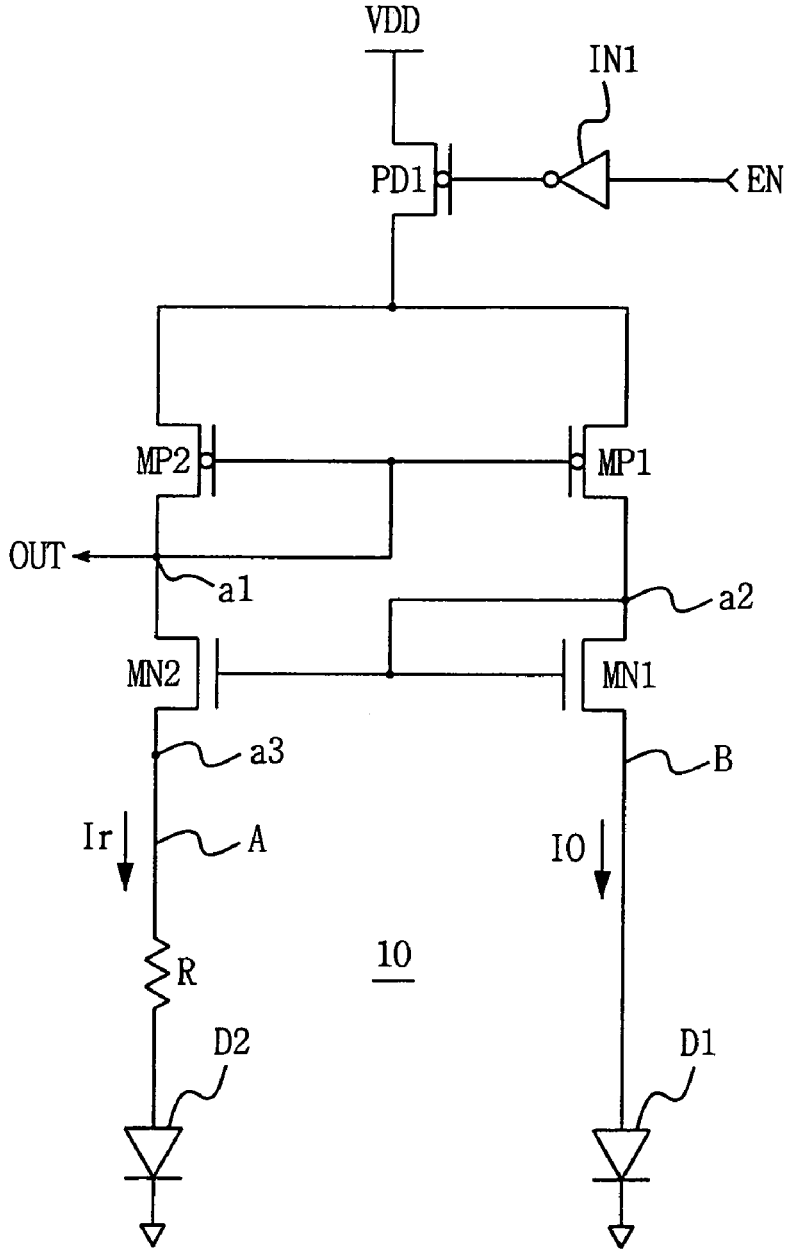
FIG.1(PRIOR ART)
FIG. 1 is a schematic diagram showing a typical band-gap reference type reference voltage generating circuit.
Figure 2:
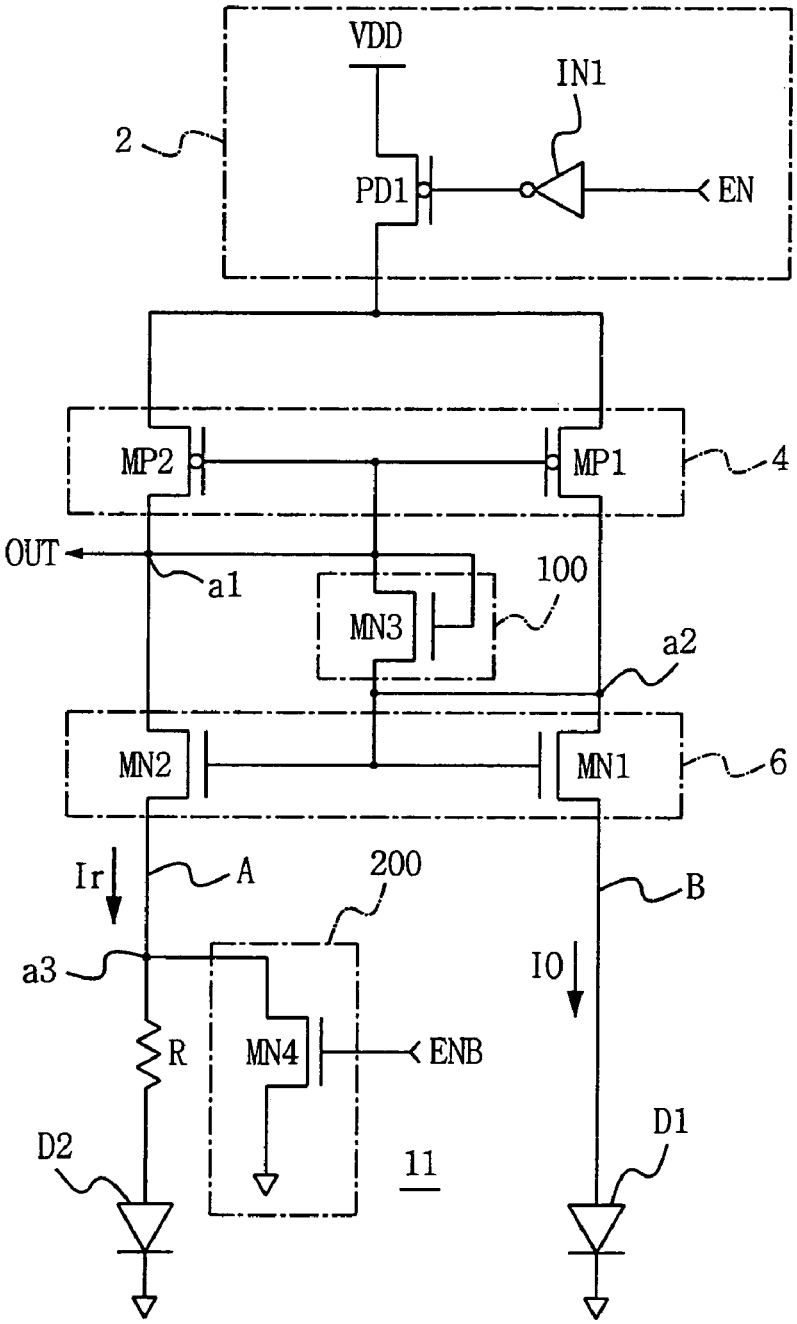
FIG. 2 is a schematic diagram showing a reference voltage generating circuit according to an embodiment of the present invention.

FIG. 2 is a diagram showing a reference voltage generating circuit according to an embodiment of the present invention. Referring to the figure, shown is a reference voltage generating circuit 11 comprising a charge transporting section 100 connected between a gate terminal of a first MOS transistor MP2 of a first conductivity type in a first current mirror 4 and a gate terminal of a fourth MOS transistor MN1 of a second conductivity type in a second current mirror 6, and a current sink section 200 for connecting a source terminal of a third MOS transistor MN2 of the second conductivity type to a ground voltage VSS in response to a second switching control signal ENB, in addtion to the configuration of FIG. 1 including a driving switching section 2. Although not shown, a filter section may be employed, which is connected in parallel with diodes D2 and Dl and to a ground to eliminate switching noise.

The charge transporting section 100 may include a fifth MOS transistor MN3 of the second conductivity type performing a diode function. The current sink section 200 may include a sixth MOS transistor MN4 of the second conductivity type, the sixth MOS transistor MN4 having a gate terminal for receiving the second switching control signal ENB, a drain terminal connected to a first current path, and a source terminal connected to the ground voltage.

Figure 3:
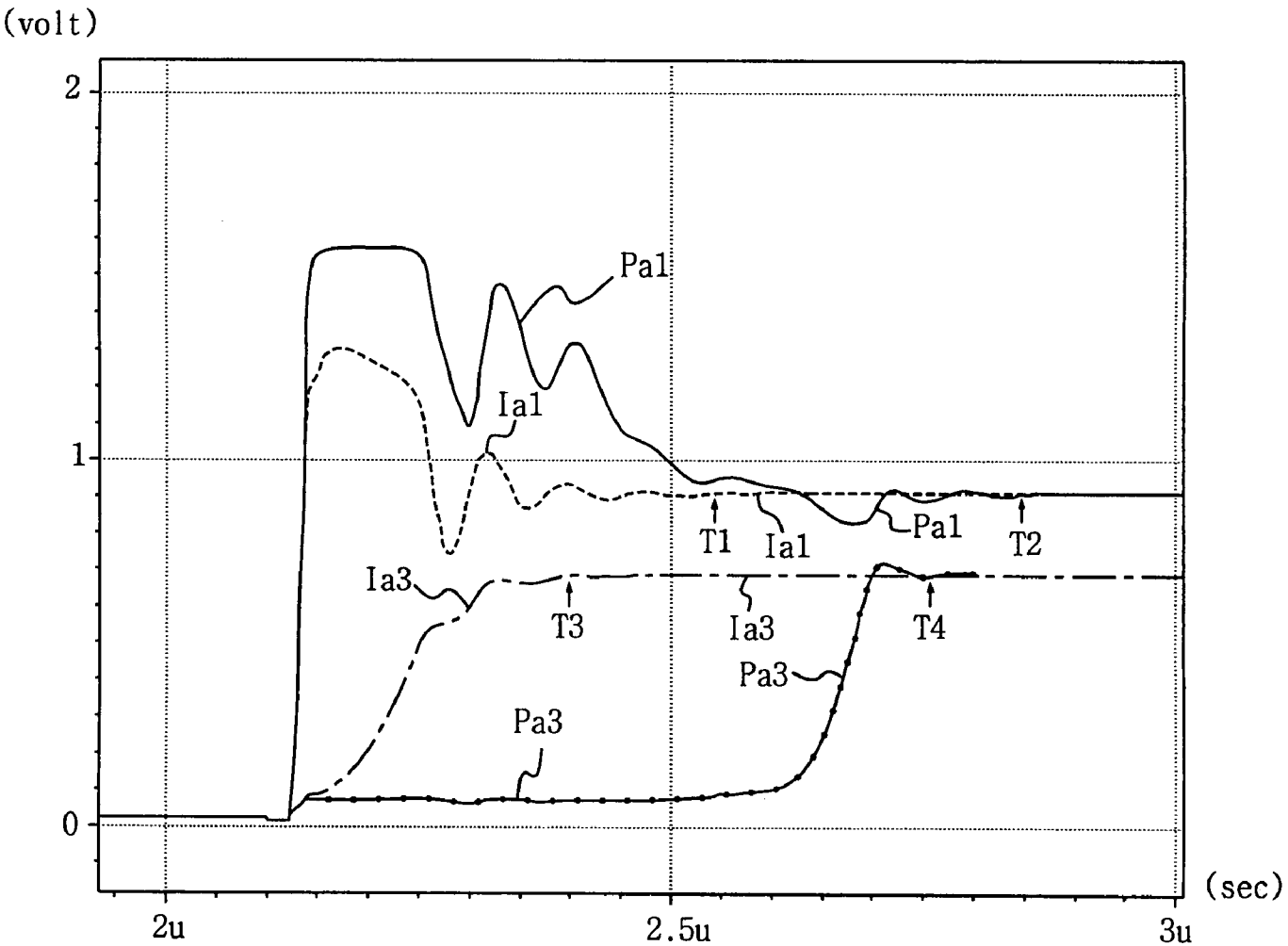
FIGS. 3 and 4 are comparison graphs showing waveforms of signals at nodes in a reference voltage generating circuit.
Figure 4:
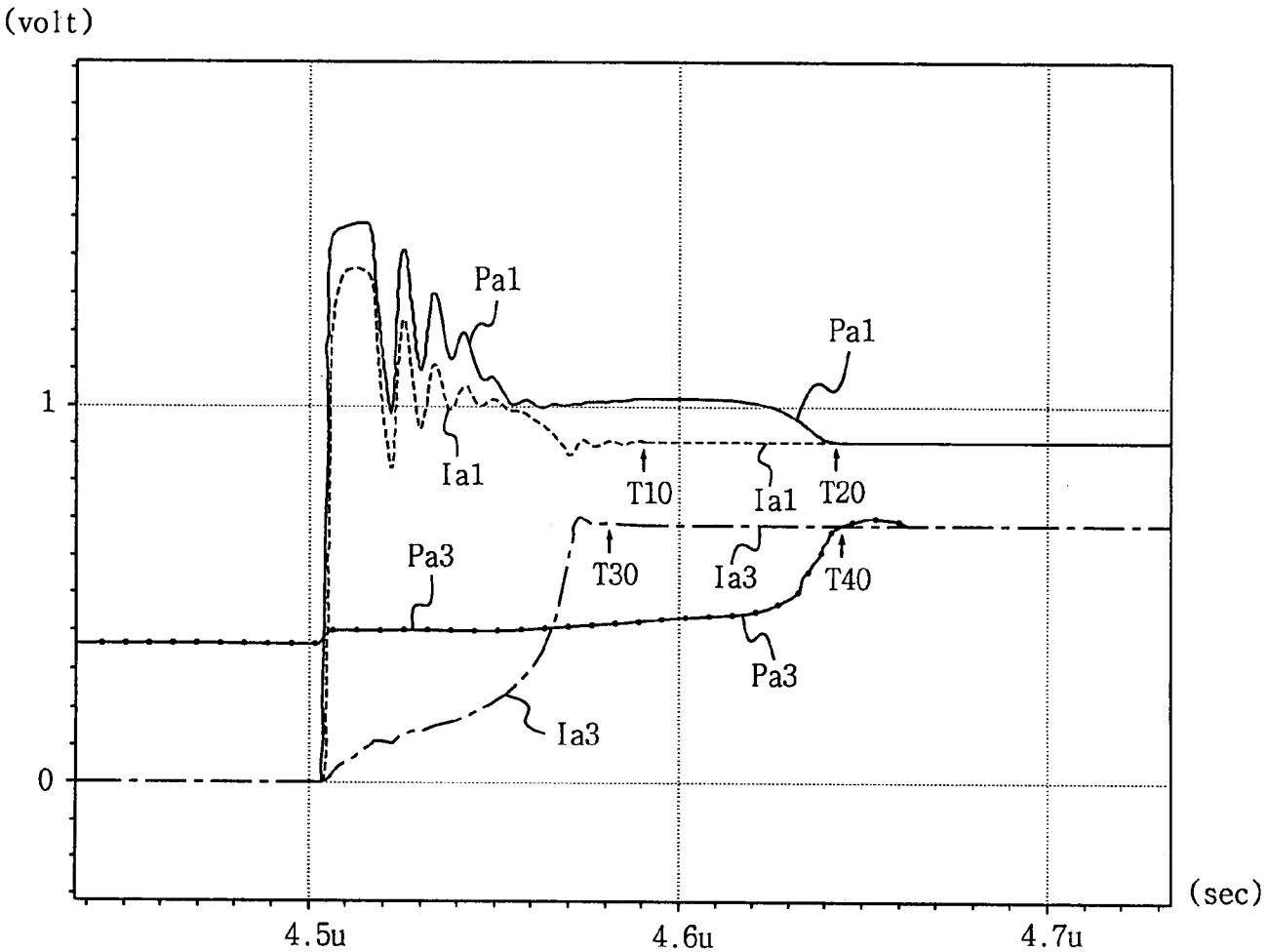

FIGS. 3 and 4 are graphs showing comparably waveforms of signals at nodes in a reference voltage generating circuit. FIG. 3 shows comparison between a case where the charge transporting section 100 is used and a case where the charge transporting section 100 is not used, wherein an abscissa axis denotes time and an ordinate axis denotes voltage. FIG. 4 shows comparison between a case where the current sink section 200 is used and a case where the current sink section 200 is not used, wherein an abscissa axis represents time and an ordinate axis denotes voltage.

Hereinafter, the operation of the reference voltage generating circuit shown in FIG. 2 will be described specifically with reference to FIGS. 3 and 4.

In FIG. 2, if the switching control signal EN is alternated between a high state and a low state in a short time, the P-type MOS transistor PD1 is repeatedly turned ON and OFF, and the operation of the reference voltage generator solves the conventional problems in a manner below.

First, if a high switching control signal EN is applied, the P-type MOS transistor PD1 is turned ON and in turn the P-type MOS transistors MP1 and MP2 of the first current mirror section begin to be turned ON. At this time, even though a voltage level at a reference voltage output node a1 rises earlier than a voltage level at a node a2, the P-type MOS transistors MP1 and MP2 is not in a turn-off state easily until the voltage level at the node a2 rises to a sufficient level. That is, even though the voltage level at the reference voltage output node a1 rises earlier than the voltage level at the node a2, a turn-on operation of the N-type MOS transistor MN3 performing a diode function prevents the P-type MOS transistors MP1 and MP2 making up the first current mirror from being turned OFF. Specifically, the N-type MOS transistor MN3 is turned ON when a voltage Vgs between the gate and the source becomes higher than a threshold voltage Vth, allowing charges developed at the reference voltage output node a1 to be moved into the node a2. Accordingly, the voltage level at the node a1 is instantaneously dropped while the voltage level at the node a2 rises to a sufficient level, such that the second current mirror section quickly matures into its stable current mirror operation.

Referring to FIG. 3, a graph Pa1 denotes a curve of the voltage at the node a1 of FIG. 1, and a graph Ia1 denotes a curve of the voltage at the node a1 of FIG. 2. It can be seen from comparison of the two graphs Pa1 and Ia1 that in the case of the graph Ia1, a setting time point T1 of the reference voltage output OUT is made faster than a time point T2 of the prior art since the operation of the second current mirror section is quickly performed due to the operation of the N-type MOS transistor MN3 performing a diode function. Further, a graph Pa3 denotes a curve of the voltage at the node a3 of FIG. 1, and the graph Ia3 denotes a curve of the voltage at the node a3 of FIG. 2. It can be also seen from comparison of the two graphs Pa3 and Ia3 that in the case of the graph Ia3, a setting time point T3 at the node a3 is faster than a time point T4 of a prior art since the operation of the second current mirror section is quickly performed due to the operation of the N-type MOS transistor MN3 performing a diode function. As a result, a high-speed response characteristic is realized.

On the other hand, if the switching control signal EN is applied in the low state, the P-type MOS transistor PD1 is turned OFF and in turn the P-type MOS transistors MP1 and MP2 of the first current mirror section and the N-type MOS transistors MN1 and MN2 of the second current mirror section are also turned OFF. In the case of FIG. 1, the voltage level at the node a3 is in a floating state by the first resistor R and the first diode D2 while in the case of FIG. 2, the N-type MOS transistor MN4 as the current sink section 200 is turned ON, so that the voltage level at the node a3 is dropped to the level of the ground voltage. Thus, in the case of FIG. 2, because the node a3 is in the level of the ground voltage rather than in the floating state, the first and second current mirror sections quickly mature into their normal operation when the switching control signal EN is applied back in the high state. That is, the current sink section 200 serves to increase a voltage Vgs between the gate and the source of the second current mirror section upon transition from a power-off state to a power-on state, such that the fast current mirror operation is accomplished.

Referring to FIG. 4, a graph Pa1 denotes a curve of the voltage at the node a1 of FIG. 1, and a graph Ia1 denotes a curve of the voltage at the node a1 of FIG. 2. It can be seen from comparison of the two graphs Pa1 and Ia1 that in the case of the graph Ia1, the setting time point T10 of the reference voltage output OUT becomes faster than the time point T20 of a prior art since the current mirror operation upon re-application of power is quickly performed due to a charge discharge operation of the N-type MOS transistor MN4 acting as a current sink section. Further, a graph Pa3 denotes a curve of the voltage at the node a3 of FIG. 1, and a graph Ia3 denotes a curve of the voltage at the node a3 of FIG. 2. It can be also seen from comparison of the two graphs Pa3 and Ia3 that in the case of the graph Ia3, the setting time point T30 at the node a3 becomes faster than the time point T40 of a prior art by tens or more of nanoseconds since the high-speed operation of the second current mirror section is achieved upon re-application of power due to a floating-prevention operation of the N-type MOS transistor MN4. As a result, a high-speed response characteristic is realized upon the re-application of power.

As described above, in the circuit of FIG. 2, the current mirror quickly matures its stable operation when power is initially supplied while the floating node becomes a ground level when the power is not supplied, resulting in a high-speed operation of the current mirror upon next application of the power.

Figure 5:
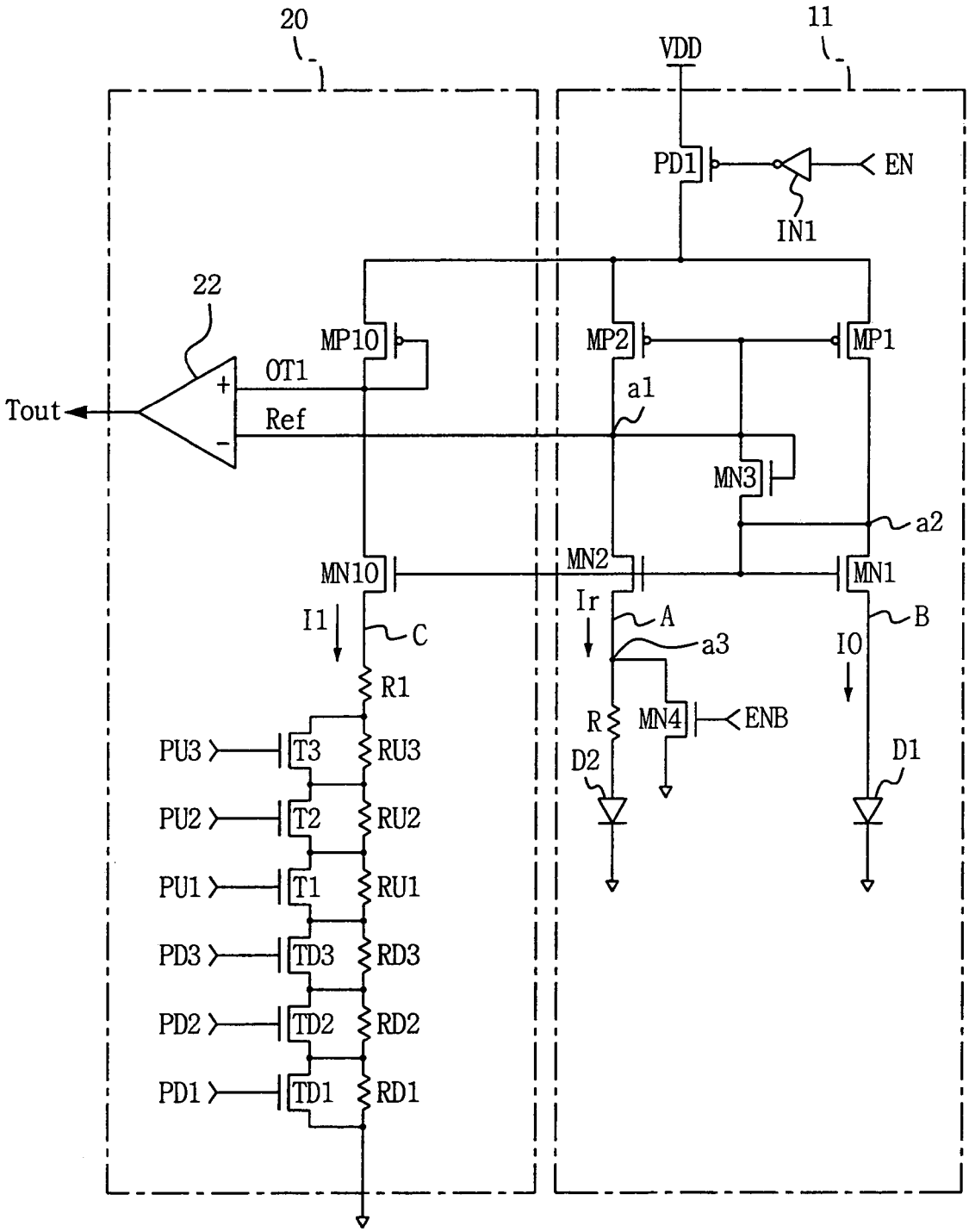
FIG. 5 is a diagram showing a temperature sensor circuit in which the circuit of FIG. 2 is applied to an on-chip semiconductor temperature sensor, in accordance with the invention.

FIG. 5 shows an example of a temperature sensor circuit in which the circuit of FIG. 2 is applied to an on-chip semiconductor temperature sensor. Referring to the figure, a conventional temperature sensor employing a band-gap reference circuit is composed of an enhanced reference voltage generating circuit 11 as shown in FIG. 2, and a temperature sensing section 20.

The temperature sensing section 20 includes P-type and N-type MOS transistors MP10 and MN10; resistors R1, RU3, RU2, RU1, RD3, RD2, and RD1 connected to a reduction resistance branch C where a current is reduced with temperature increase; N-type MOS transistors T3, T2, T1, TD3, TD2 and TD1; and a comparator 22 for comparing a reference temperature voltage Ref and a sensed temperature voltage OT1 and outputting a compare result as a compare output signal Tout.

Junction diodes D2 and D1 connected to the branches A and B in the reference voltage generating circuit 11 have the same size, the P-type MOS transistors MP1, MP2 and MP10 making up the temperature sensor circuit have a size ratio of 1:1:1, and the N-type MOS transistors MN1, MN2 and MN10 have a size ratio set to 1:1:1 as well. Here, the size indicates a channel length L multiplied by a gate width W.

The operation of the temperature sensor circuit shown in FIG. 5 will be described below. In the reference voltage generating circuit 11, current mirror operations of the P-type MOS transistors MP1 and MP2 and the N-type MOS transistors MN1 and MN2 results in a current flow of Io:Ir=1:1, allowing the voltages at the branches A and B to be the same level.

Since the current flowing through the branch A becomes Ir=VT*ln(M)/R, a current proportional to the increase of temperature will flow through the branch A. Further, allowing the currents I1 and IO to flow with a similar area results in the voltage VC across the branch C substantially identical to the VB value, thereby obtaining VB=VD1=VT*ln(IO/Is). Normally, since a reverse saturation current Is significantly increases with the increase of the temperature relative to the VT, a characteristic is obtained in which the diode voltage is decreased with the temperature. That is, since the VC is decreased with the increase of the temperature, I1 is decreased with the temperature.

Figure 6:
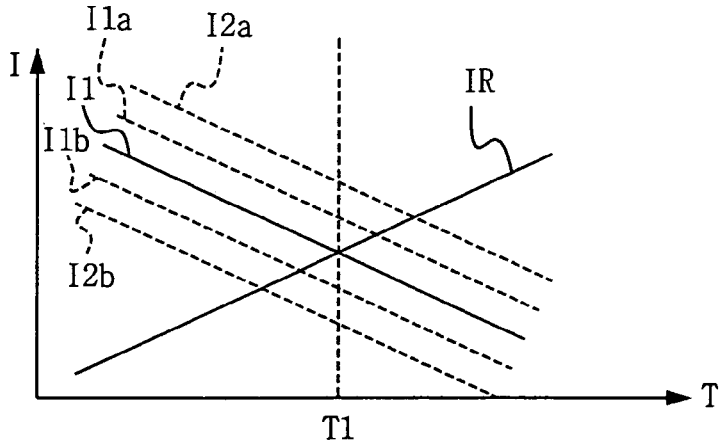
FIGS. 6 and 7 are graphs related to FIG. 5.

Therefore, tuning the resistance of the reduction resistance branch C enables the values Ir and I1 to be crossed at a particular temperature, as shown in FIG. 6. As a result, the temperature sensor circuit of FIG. 5 functions as a temperature sensor designed to have a trip point at particular temperature T1.

Figure 7:
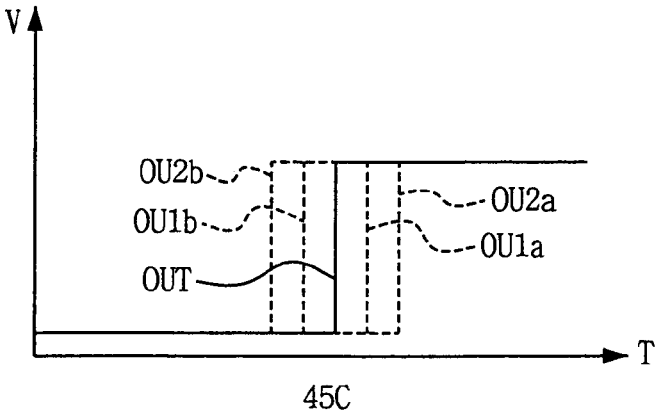

FIG. 6 is a graph showing temperature vs. current change at the resistor branches according to the operation of the temperature sensor circuit of FIG. 5, where an abscissa axis denotes temperature and an ordinate axis denotes current. If it is assumed that particular temperature T1 in FIG. 6 is for example 45° C., the output signal Tout outputted from the comparator 22 has a waveform OUT, as shown in FIG. 7. FIG. 7 shows the output waveform of the comparator 22 according to the temperature sensing operation of FIG. 5, where an abscissa axis denotes temperature and an ordinate axis denotes voltage.

If the built-in temperature sensor as shown in FIG. 5 is applied to a semiconductor memory device, for example, a DRAM, a temperature tuning task is performed on the temperature sensor. This is because elements making up the temperature sensor have a property that it is sensitive to change in manufacture processes, resulting in change in a trip point.

In FIG. 5, the transistors T3, T2 and T1 of the N-type MOS transistors T3, T2, T1, TD3, TD2 and TD1 are controlled by the control signals PU3, PU2 and PU1 and normally remain in a turn off state. If the transistors T3, T2 and T1 are turned ON, mixed resistance of the branch C is reduced since the respective corresponding resistors are operably shortened. Accordingly, the current flowing through the branch C increases, resulting in the graphs I1*a* and I2*a* of FIG. 6, and the output of temperature sensor circuit results in the outputs OU1*a* and OU2*a*, as shown in FIG. 7. As a result, the temperature trip point of the temperature sensor rises.

On the other hand, the transistors TD3, TD2 and TD1 of the N-type MOS transistors T3, T2, T1, TD3, TD2, and TD1 are controlled by the control signals PD3, PD2 and PD1 and normally remain in a turn-on state. If the transistors TD3, TD2 and TD1 are turned off, the respective corresponding resistors are operably released from their short state, increasing mixed resistance of the branch C. Accordingly, a current flowing through the branch C is reduced, resulting in the graphs I1*b* and I2*b* of FIG. 6, and the output of the temperature sensor circuit results in the outputs OU1*b* and OU2*b* as in FIG. 7. As a result, the temperature trip point of the temperature sensor is dropped.

As described above, provided is a temperature sensor having a desired sensing temperature by properly controlling the logical state of the control signals PU3, PU2, PU1, PD3, PD2 and PD1.

The on/off operation of the above-described temperature sensor circuit is frequently controlled by the switching control signal EN so that power is saved. In this case, since the reference voltage generating circuit 11 is a circuit having an enhanced high-speed response characteristic and stability of operation, a high-speed operation and reliable temperature sensing is implemented.

While the present invention has been particularly shown and described with reference to exemplary embodiments thereof, it will be understood by those of ordinary skill in the art that various changes in form and details may be made therein without departing from the spirit and scope of the present invention as defined by the following claims.

For example, the type and number of the transistors in the circuit of FIG. 2 may be changed without departing from technical spirit of the present invention, if necessary. The reference voltage generating circuit is not limited to the use for the temperature sensor but may be employed for other semiconductor circuits requiring a reference voltage.

With the reference voltage generating circuit for the integrated circuit as described above, an advantage is obtained in that since an initial current mirror operation can be stabilized in a short time when a drive power supply voltage is switched, the high-speed response characteristic and stability of the operation is enhanced. Thus, the reference voltage generating circuit has an advantage that it can be suitably employed as a circuit for providing a reference voltage to a temperature sensor embedded in a semiconductor memory.

What is claimed is:

1. A reference voltage generating circuit for an integrated circuit, the reference voltage generating circuit having a power supply voltage node to which a driving power supply voltage is intermittently applied, comprising:

a first current mirror section including a first MOS transistor of a first conductivity type having a source terminal connected to the power supply voltage node and a gate terminal connected to a drain terminal as a reference voltage output node, and a second MOS transistor of the first conductivity type having a gate terminal connected to the gate terminal of the first MOS transistor of the first conductivity type and a source terminal connected to the power supply voltage node;

a second current mirror section including a third MOS transistor of a second conductivity type having a drain terminal connected to the reference voltage output node and a source terminal connected to a first current path to which a first resistor and a first diode are serially connected, and a fourth MOS transistor of the second conductivity type having a gate terminal and a drain terminal connected to the gate terminal of the third MOS transistor of the second conductivity type in common and a source terminal connected to a second current path to which a second diode is serially connected;

a charge transporting section connected between the gate terminal of the first MOS transistor of the first conductivity type in the first current mirror section and the gate terminal of the fourth MOS transistor of the second conductivity type in the second current mirror section; and a current sink section for connecting the source terminal of the third MOS transistor of the second conductivity type to a ground voltage in response to a first switching control signal.

2. The reference voltage generating circuit according to claim 1, wherein the charge transporting section is a fifth MOS transistor of the second conductivity type having a drain terminal and a gate terminal connected to the gate terminal of the first MOS transistor of the first conductivity type, and having a source terminal connected to the gate terminal of the fourth MOS transistor of the second conductivity type.

3. The reference voltage generating circuit according to claim 1, wherein the charge transporting section is a third diode having an anode connected to the gate terminal of the first MOS transistor of the first conductivity type and a cathode connected to the gate terminal of the fourth MOS transistor of the second conductivity type.

4. The reference voltage generating circuit according to claim 2, further comprising;

a driving switching section for applying the driving power supply voltage to the power supply voltage node in response to a second switching control signal.

5. The reference voltage generating circuit according to claim 4, wherein the current sink section is a sixth MOS transistor of the second conductivity type having a gate terminal for receiving the first switching control signal, a drain terminal connected to the first current path, and a source terminal connected to the ground voltage.

6. The reference voltage generating circuit according to claim 5, wherein the first switching control signal has a phase opposing that of the second switching control signal.

7. The reference voltage generating circuit according to claim 1, wherein the reference voltage generating circuit for the integrated circuit is a band-gap reference type circuit for generating a reference voltage of an on-chip temperature sensor.

8. The reference voltage generating circuit according to claim 1, wherein the second conductivity type MOS transistors are N-type MOS field effect transistors when the first conductivity type MOS transistors are P-type MOS field effect transistors.

9. A reference voltage generating circuit having a power supply voltage node to which a driving power supply voltage is periodically applied, comprising:

a first current mirror section including a first MOS transistor of a first conductivity type having a source terminal connected to the power supply voltage node and a gate terminal connected to a drain terminal as a reference voltage output node, and a second MOS transistor of the first conductivity type having a gate terminal connected to the gate terminal of the first MOS transistor of the first conductivity type and a source terminal connected to the power supply voltage node;

a second current mirror section including a third MOS transistor of a second conductivity type having a drain terminal connected to the reference voltage output node and a source terminal connected to a first current path to which a first resistor and a first diode are serially connected, and a fourth MOS transistor of the second conductivity type having a gate terminal and a drain terminal connected to the gate terminal of the third MOS transistor of the second conductivity type in common and a source terminal connected to a second current path to which a second diode is serially connected;

a charge transporting section connected between the gate terminal of the first MOS transistor of the first conductivity type in the first current mirror section and the gate terminal of the fourth MOS transistor of the second conductivity type in the second current mirror section;

a driving switching section for applying the driving power supply voltage to the power supply voltage node in response to a first switching control signal; and a current sink section for connecting the source terminal of the third MOS transistor of the second conductivity type to a ground voltage in response to a second switching control signal.

10. The reference voltage generating circuit according to claim 9, wherein the charge transporting section is a fifth MOS transistor of the second conductivity type having a drain terminal and a gate terminal connected to the gate terminal of the first MOS transistor of the first conductivity type, and having a source terminal connected to the gate terminal of the fourth MOS transistor of the second conductivity type.

11. The reference voltage generating circuit according to claim 10, wherein the driving switching section comprises:

an inverter for inverting the phase of the first switching control signal; and a first conductivity type MOS transistor having a gate terminal for receiving an output of the inverter, a source terminal for receiving the driving power supply voltage, and a drain terminal connected to the power supply voltage node.

12. The reference voltage generating circuit according to claim 11, wherein the current sink section is a sixth MOS transistor of the second conductivity type having a gate terminal for receiving the second switching control signal, a drain terminal connected to the first current path, and a source terminal connected to the ground voltage.

13. The reference voltage generating circuit according to claim 11, wherein the circuit is applied to a semiconductor temperature sensor.

* * * * *